US010149796B1

(12) United States Patent
Souney

(10) Patent No.: US 10,149,796 B1
(45) Date of Patent: Dec. 11, 2018

(54) PNEUMATIC COMPRESSION DEVICES AND GARMENTS FOR THE PREVENTION OF DEEP VEIN THROMBOSIS

(71) Applicant: Currie Medical Specialties, Inc, Rancho Cucamonga, CA (US)

(72) Inventor: Sean Souney, Rancho Cucamonga, CA (US)

(73) Assignee: Currie Medical Specialties, Inc., Rancho Cucamonga, CA (US)

( * ) Notice: Subject to any disclaimer, the term of this patent is extended or adjusted under 35 U.S.C. 154(b) by 650 days.

(21) Appl. No.: 14/791,178

(22) Filed: Jul. 2, 2015

Related U.S. Application Data

(60) Provisional application No. 62/020,377, filed on Jul. 2, 2014, provisional application No. 62/187,780, filed on Jul. 1, 2015.

(51) Int. Cl.
*A61H 7/00* (2006.01)
*A61H 19/00* (2006.01)
*A61H 9/00* (2006.01)

(52) U.S. Cl.
CPC ..... *A61H 9/0078* (2013.01); *A61H 2209/00* (2013.01)

(58) Field of Classification Search
CPC ..... A61H 1/006; A61H 9/005; A61H 9/0071; A61H 9/0078–9/0085; A61H 33/028; A61H 2201/5071; A61H 2209/00
See application file for complete search history.

(56) References Cited

U.S. PATENT DOCUMENTS

2001/0027300 A1* 10/2001 Hartig ..... A61M 1/0084 604/285
2006/0083623 A1* 4/2006 Higgins ..... A61H 9/0078 417/44.2
2010/0249679 A1* 9/2010 Perry ..... A61H 9/0078 601/148
2011/0098611 A1* 4/2011 Flood ..... A61H 9/0078 601/41
2012/0083712 A1* 4/2012 Watson ..... A61B 5/026 600/587
2014/0094726 A1* 4/2014 Malhi ..... A61F 13/08 601/152
2014/0207036 A1* 7/2014 Perry ..... A61H 9/0078 601/149
2014/0276283 A1* 9/2014 Mansur, Jr. ..... A61H 9/0078 601/150
2015/0224012 A1* 8/2015 Wright ..... A61H 9/0078 601/150
2015/0374571 A1* 12/2015 Denson ..... A61H 1/008 601/150
2017/0172838 A1* 6/2017 Brosnan ..... A61H 9/0078

* cited by examiner

*Primary Examiner* — Nyca T Nguyen
(74) *Attorney, Agent, or Firm* — Paul H. Heynssens; Ater Wynne LLP

(57) ABSTRACT

A pneumatic compression device for non-invasive external intermittent pneumatic compression system used as prophylaxis for reducing the incidence of Deep Vein Thrombosis (DVT). The system consists of a pneumatic compression pump, valves for control of air flow, a pressure sensor, and a controlling circuitry. The controlling circuitry receives input from the pressure sensor and switch ON/OFF one or more control valves based on the pressure sensor input to dynamically controlling the pressure of the regulated compressed air flow.

11 Claims, 10 Drawing Sheets

PNEUMATIC COMPRESSION DEVICES AND GARMENTS FOR THE PREVENTION OF DEEP VEIN THROMBOSIS

CROSS-REFERENCE TO RELATED APPLICATION

This application claims the benefit of U.S. Provisional Patent Application No. 62/020,377 filed Jul. 2, 2014, and U.S. Provisional Patent Application No. 62/187,780 filed Jul. 1, 2015, the contents of which are hereby incorporated by reference.

TECHNICAL FIELD

This description relates generally to medical devices and more specifically to devices for periodically compressing a part of a human body to improve circulation, and to prevent blood clots.

BACKGROUND

The technology of compressing a part of a body to improve circulation can be applied to several medical conditions, such as peripheral artery disease, venous insufficiency, lymphedema, and prevention of Deep Vein Thrombosis. Deep vein thrombosis (DVT) is a blood clot in a large vein, usually in the leg or pelvis. Sometimes the blood clot detaches from the site of formation and becomes mobile. If the circulating clot moves through the heart to the lungs, it can block an artery supplying blood to the lungs, resulting in pulmonary embolism. The disease process that includes DVT and/or pulmonary embolism is called venous thromboembolism (VTE). Each year in the United States, approximately 350,000-900,000 persons develop VTE, and of those, approximately 100,000 die. Additionally, 30%-50% of persons with lower-extremity DVT develop a long-term complication that causes swelling, pain, discoloration, and, in severe cases, ulcers in the affected limb.

It is therefore desirable to provide an effective, user friendly, and patient compliant pneumatic compression device and garment, including a system in order to achieve effective treatment, which are important components to promoting patient compliance and positive clinical outcomes.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a non-invasive external intermittent pneumatic compression system used as prophylaxis for reducing the incidence of Deep Vein Thrombosis (DVT). The system may consist of a pneumatic compression pump, valves for control of air flow, a pressure sensor, and an orifice. Also included is a method of operating the pneumatic compression pump. The system also includes a variety of breathable garments, including foot, calf-length, thigh-length, and the like, and a unique device for coupling the pneumatic compression pump to the garment. The compression system is designed to be a user friendly and patient compliant system that will help prevent the formation of clots.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a unique intermittent pneumatic compression system that may include a pneumatic compression device, interconnections, and garments that may be useful for the prevention of DVT. As those skilled in the art will appreciate, the present examples are suitable for application in a variety of different types of external compression systems.

Figure 1:
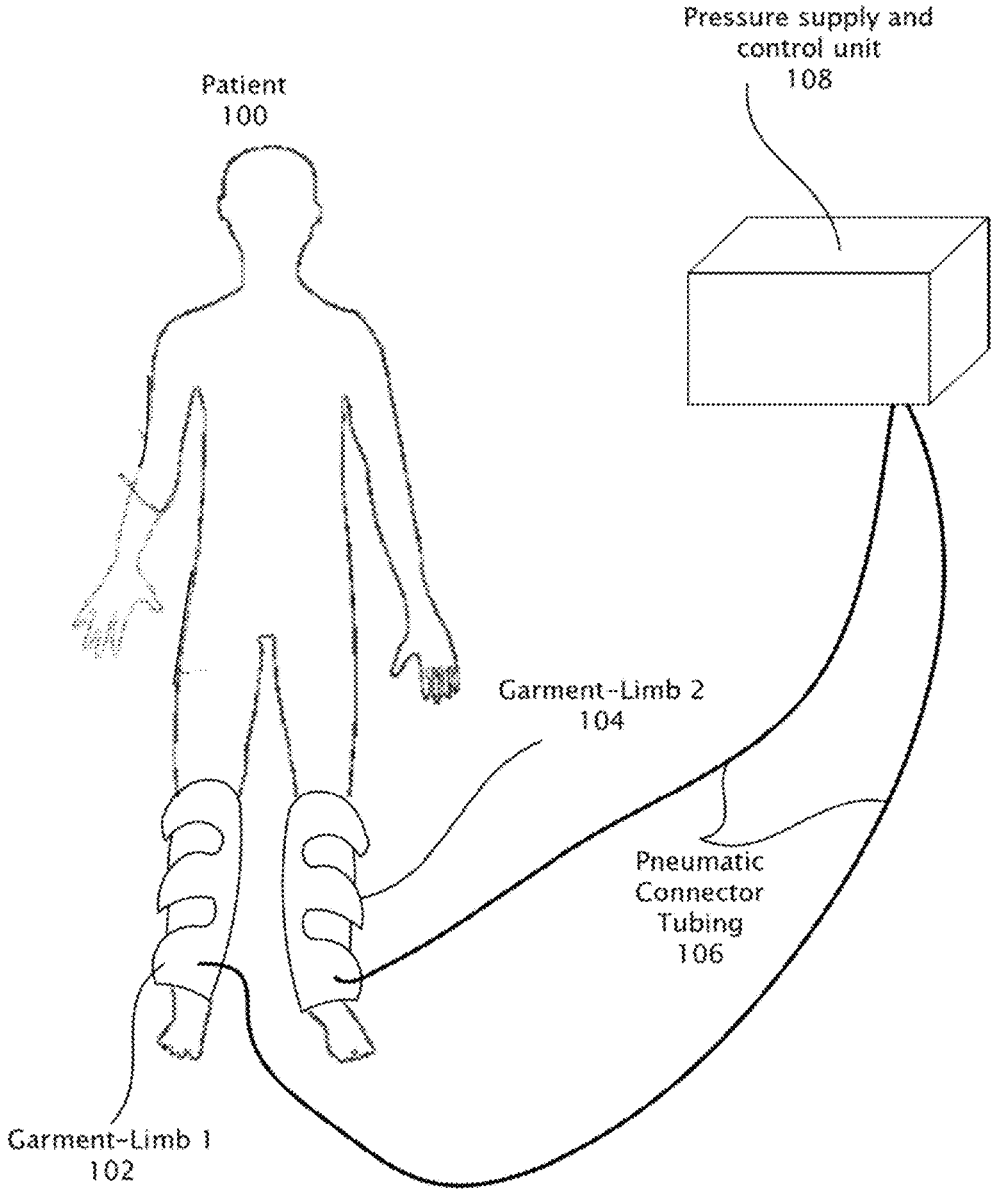
FIG. 1 is a system diagram showing of a patient being treated with an example of the pneumatic compression device and garment described herein.

FIG. 1 is an overview of a patient being treated with an intermittent pneumatic compression system of the present invention. The patient 100 is shown being treated to prevent DVT, and is wearing a compression garment 102 on the right leg and a compression garment 104 on the left leg. The pressure supply and control unit 108 pressurizes the limb garments 102, 104, via the tubing 106, by supplying varying amounts of pressure at varying times. This varying pressure applied to areas covered by the garments 102, 104 tends to help prevent the formation of blood clots. Although two garments are shown, any number of garments may be used in alternative examples.

Although the patient 100 is shown wearing calf-length garments, garments can be calf-length, foot length, thigh length or configured as appropriate for other appendages, such as the hands and arms. The unique pressure supply and control unit 108 is coupled to the compression garments 102 and 104 via pneumatic connector tubing 106 that may include connectors designed to facilitate proper hook up. The tubing 106 is typically made from a flexible plastic material such as PVC, polyethylene, or similar materials. In one alternative example, the tubing 106 is an anti-kink, and anti-crush air delivery tube. A stat or ribbed flexible extrusion may be disposed at the center of the pneumatic connector tubing 106. In a further alternative example a unique identification mechanism may be incorporated into the tubing connections.

The pressure supply and control unit 108 is constructed as a portable external medical device designed to operate on line voltage, on battery backup power, or the like. The pressure supply and control unit 108 provides compressed air to the garments such that the medically desired inflation and deflation pressures and rate of inflation and deflation are applied to the limbs of the patient 100. The pressure supply and control unit contain a pump and a manifold mechanism operating according to a unique process for controlling air movement to and from the garments.

Figure 2:
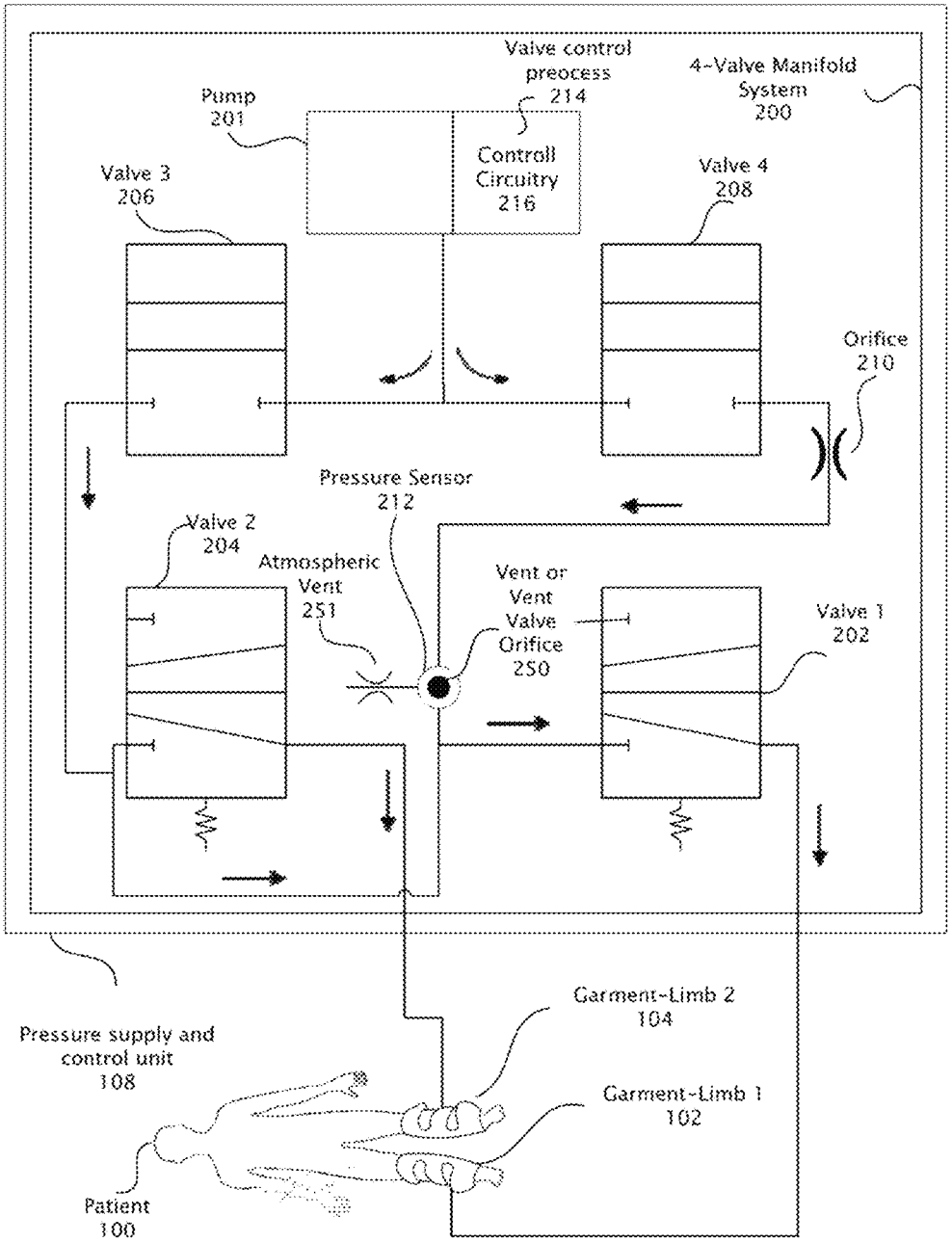
FIG. 2 shows further detail of the specially constructed four-valve air delivery manifold contained in the pressure supply and control unit for controlling air movement to the garments.

FIG. 2 shows an air flow schematic of the four-valve air delivery manifold that may be used for controlling air movement to the garments under control of a unique valve control process 214, as controlled by a controlling circuitry 216. The 4-valve manifold system 200 may be contained within the pressure supply and control unit 108. The 4-valve manifold system includes a pump (or equivalently a compressor, or a compressor pump) 201 to provide compressed air to the system. The flow of the compressed air may be controlled by four valves 202, 204, 206, and 208, an orifice 210, and a pressure sensor 212, all of which may be activated and otherwise controlled by process 214. Also included is an atmospheric vent 251, and a vent orifice 250. This works well for sea level situations, but where the elevation is above sea level it is desirable that the patient receives the optimal pressure differential above the pressure that the patient is at, relative to ground level thereby insuring you have an optimal clinical pressure differential at for example a mile high city like Denver. This feature is implemented in an exemplary 5 valve design.

An additional example may be a 5-valve manifold which utilizes the same unique 4-way valve schematic as described above but may include an extra 3-way valve that is plumbed inside the manifold, upstream of the two three way valves that supply and distribute air to the limbs. The extra 3-way valve eliminates the typical need for an air bleed orifice in the manifold block (normally placed in conjunction with the pressure transducer line) since when the leg air distribution valves close and stop supplying air to the limb, air pressure must vent to zero pressure (relative to the ambient air pressure) before the start of the next cycle of pressure to the next limb so that a calibrated and measured pressure that is in a therapeutic range above the ambient air pressure is delivered to the limb on the following cycle.

The additional example may include an extra three way valve that is between the leg output valves 1 and 2 and the incoming control valves 3 and 4. This extra three way valve is a normally closed valve which eliminates the need for a bleed orifice in the block that brings its internal pressure between leg compressions to zero pressure. When this extra valve shuts off and de-energizes it is normally closed and therefore any air pressure in the manifold goes to zero (relative to the ambient air pressure) before the start of the next cycle. Because this valve zeroes the pressure in the block like the bleed/vent orifice in the four valve system, this insures delivery of an optimum, clinically proven exemplary 40 mm Hg above the variable air pressure on the patient which may be seen at altitude." This feature may be useful because conventional systems typically do not compress at the clinically proven values of pressure above the zeroed values of where the patient is being treated and therefore don't take into account a patient well below sea level or well above sea level.

Pump 201 supplies air to valve 3 206, and valve 4, 208. Valve 4 is coupled to valve 2, 204, and to valve 1, 202 via the pressure sensor 212, and orifice 210. Valve 2, 204 is also coupled to garment limb 2, 104.

Valve 1, 202 is coupled to valve 2, 204 before the pressure sensor 212. The output of valve 1, 201 is an output coupled to Garment limb 1, 102. The direction of airflow is generally shown by the arrows on the diagram.

In one example, valve 1 202 and valve 2 204 are conventionally constructed normally closed 3-way valves. When they are de-energized, such as would occur in a fault condition, like a depleted battery or power failure, they vent to atmosphere, effectively eliminating any air pressure in the garment and system providing additional patient safety. Valve 1 202 and valve 2 204 are two downstream distribution valves to route the compressed air flow to garment 1 and garment 2 respectively.

Valve 3 206 and valve 4 208 are normally closed 2-way valves so when they are energized, the valves open, allowing air flow. Valve 3 206 and valve 4 208 are configured as two parallel upstream valves.

The exemplary air delivery manifold system design controls air movement to the garments 102 and 104. The 4-valve manifold system is a dynamic system designed to function with the compression garments of the present example that deliberately leak air. The deliberate air leakage of the present example provides for an added level of safety to the patient. The pressure within a garment moves to zero pressure in any of the risk scenarios are encountered. For example where the deflation of a garment might be prevented, such as batteries losing power, power interruptions, wires breaking, valves sticking, a patient occluding the tubing in their sleep when the garment is inflated, or circuit boards de-energized; the present example allow for the pressure to be released.

An example of the activation and utilization of the 4 valve manifold system can be as follows: The pump 201 provides compressed air to the system. When inflation of a garment is indicated by the unit 108, valves 3 and 4 open, and valve 1 opens. Air rapidly fills the garment 102, primarily through valve 3 206. When a predetermined therapeutic pressure in the garment 102 is reached (conveniently termed the "fast fill" of the garment bladders), the pressure sensor 212 indicates that valve 3 should close. The garment 102 leaks air and the pressure is maintained at the therapeutic pressure for a therapeutic time by airflow through the orifice 210 placed after valve 4. The deliberate leakage of air from the garment while in use allows for improved maintenance of pressure in the garments. The orifice 210 placed after valve 4 208 is designed so the air flow rate through the orifice is approximately that of the air leak rate of the garments under the predetermined therapeutic pressure. Therefore, when valve 3 is closed, valve 4 still feeds air lost by the garment to keep the garment at the therapeutic pressure through the secondary pathway with a small orifice. Additionally this form of hysteresis of fill, leak, fill, around a set pressure tends to provide additional therapeutic benefits by moving volumes of blood towards the heart.

The pressure sensor 212 directs valve 4 to close if the upper pressure set-point is reached, or to open if the lower pressure set-point is reached, thereby providing a dynamic response to the pressure within the garment. When the pressure has been applied for the designated time, valve 1 and valve 4 close. The above scenario is repeated on the other limb through valve 2 204 and garment 104.

Figure 3:
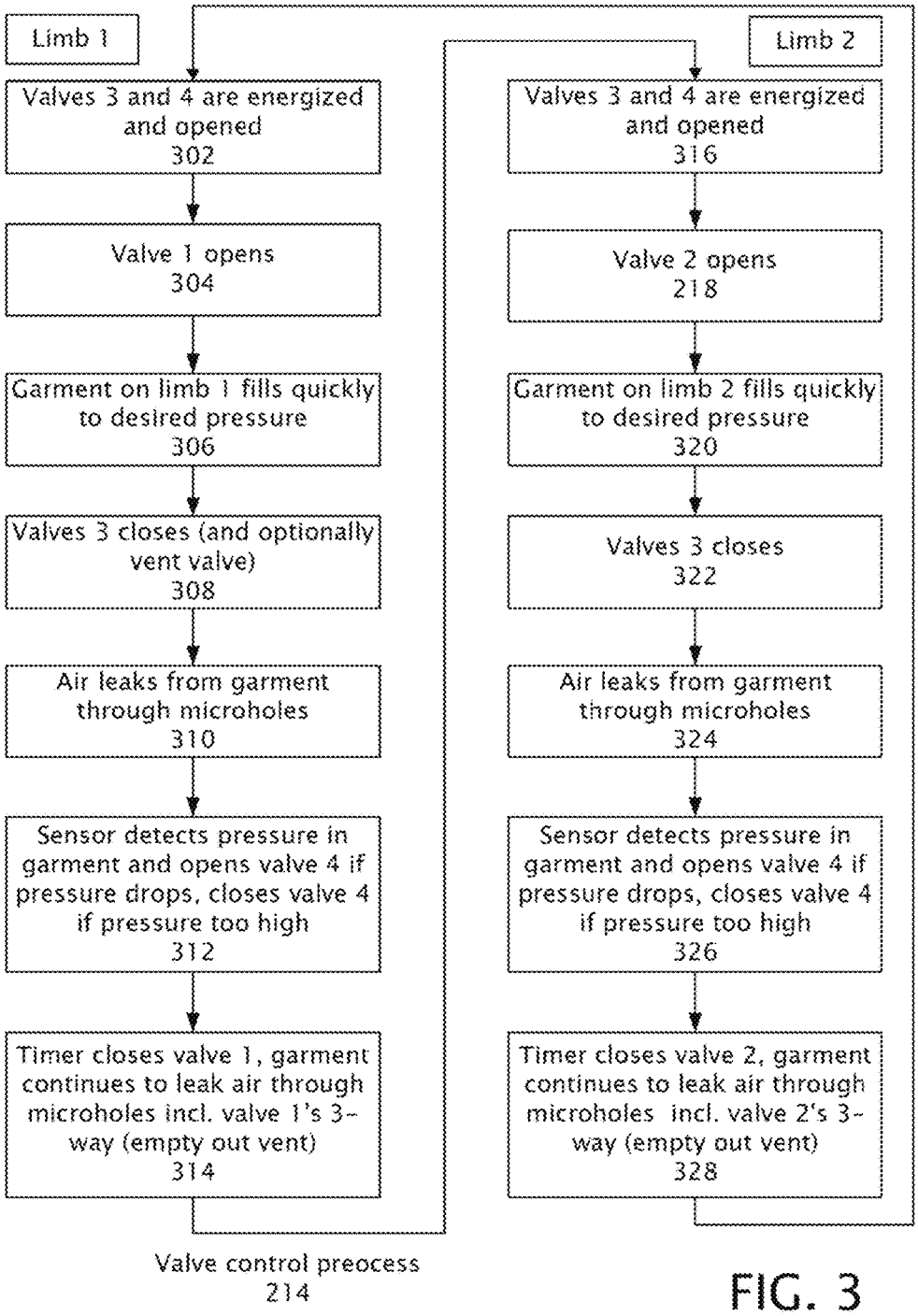
FIG. 3 is a block diagram showing a process of operating of the four-valve air delivery manifold.

FIG. 3 is a block diagram of the operation of the four-valve air delivery manifold. Beginning at Limb 1 at block 302, both valves 3 (206 of FIG. 2) and 4 (208 of FIG. 2) are energized and opened to allow air to flow. At block 304, the circuitry energizes valve 1 (202 of FIG. 2) to open it. Valve 2 (204 of FIG. 2) remains closed. At block 306, the garment on the first limb (102 of FIG. 2) fills to a first predetermined pressure, such as 40 mmHg for prevention of DVT, primarily through valve 3. This is because the air flow from valve 4 is throttled by the orifice.

When the pressure in the garment (102 of FIG. 2) reaches the first predetermined pressure as desired therapeutic level, the pressure sensor (212 of FIG. 2) signals the controlling circuitry (216 of FIG. 2) to close valve 3 at block 308 so that air flow to the garment is solely through the orifice (210 of FIG. 2) throttling air flow from valve 4. At block 310, air leaks from micro holes (not shown) in the garment (102 of FIG. 2) on the first limb at about the same rate as air is supplied via the orifice (210 of FIG. 2). At block 312, the sensor (212 of FIG. 2) detects air pressure of the air flow fed to the garment, and if the pressure exceeds a programmed upper set-point, valve 4 closes. If the pressure drops below a programmed lower set-point, it causes valve 4 to open and increase the pressure in the garment to the desired level, providing dynamic control of the pressure within the garment. Once at the upper set-point, valve 4 closes in what approximates a hysteresis loop of controlling pressure and at the same time having a safety system built in.

At block 314, a timer (not shown) causes valve 1 (202 of FIG. 2) to close after pressure has been applied for a predetermined amount of time. 'The timer closes valve 1, the garment vents air and pressure through the 3 way valve and continues to leak air through micro-holes that may be present. Air continues to leak from the garment through the micro holes until the pressure reaches 0 mmHg. The process next controls the inflation of the garment on limb 2 (104 of FIG. 2)

Now the inflation of the garment on limb 2 is described. At block 316, the controlling circuitry energizes and opens valves 3 and 4. At block 318, valve 2 (204 of FIG. 2) opens and at block 320, the garment (204 of FIG. 2) on limb 2 fills quickly to a second predetermined pressure. In one example, the first predetermined pressure is the same as the second predetermined pressure. In another example, the first predetermined pressure is different from the second predetermined pressure. Valve 3 (206 of FIG. 2) closes at block 322. At block 324, as before, air leakage through the micro holes in the garment is supplemented by air flowing through the orifice from valve 4 (208 of FIG. 2). At block 326, valve 4 (208 of FIG. 2) is closed if the pressure reaches the upper set-point, opens valve 4 if the pressure drops to the lower set-point, and valve 4 opens and closes to maintain the pressure in the garment at the appropriate therapeutic level. The upper set-point and lower set-point for the garment 102 on limb 1 may be the same as or different from the upper set-point and lower set-point for the garment 104 on limb 2. At block 328, the valve 2 (204 of FIG. 2) is closed after the predetermined amount of time and the garment on limb 2 (104 of FIG. 2) continues to leak air through the micro holes in the garment until the pressure drops to 0 mm Hg. Here the timer closes valve 2, the garment vents air and pressure through the 3 way valve and continues to leak air through micro-holes. Regarding the description above valve 1 and 2 are normally closed 3 way valves. This means that any shutoff by the system or emergency failure of power for any reason to the system, safety is maintained as these valves are closed and vent anything 'forward' of them (the tubing and the garments) to zero pressure for the sake of safety out large venting holes in the valves. So in general the timer closes valve (1 or 2), garment vents air and pressure through the 3 way valve and continues to leak air through micro-holes'. At block 302, the controlling circuitry begins the treatment cycle again. The cycles and pressures described above have been found to be useful in the prevention of clots. The absolute pressures and times of application may be determined and adjusted as needed for a given application. However the following graphs show a graphical indication of the pressures traduced in each garment over time.

Figure 4:
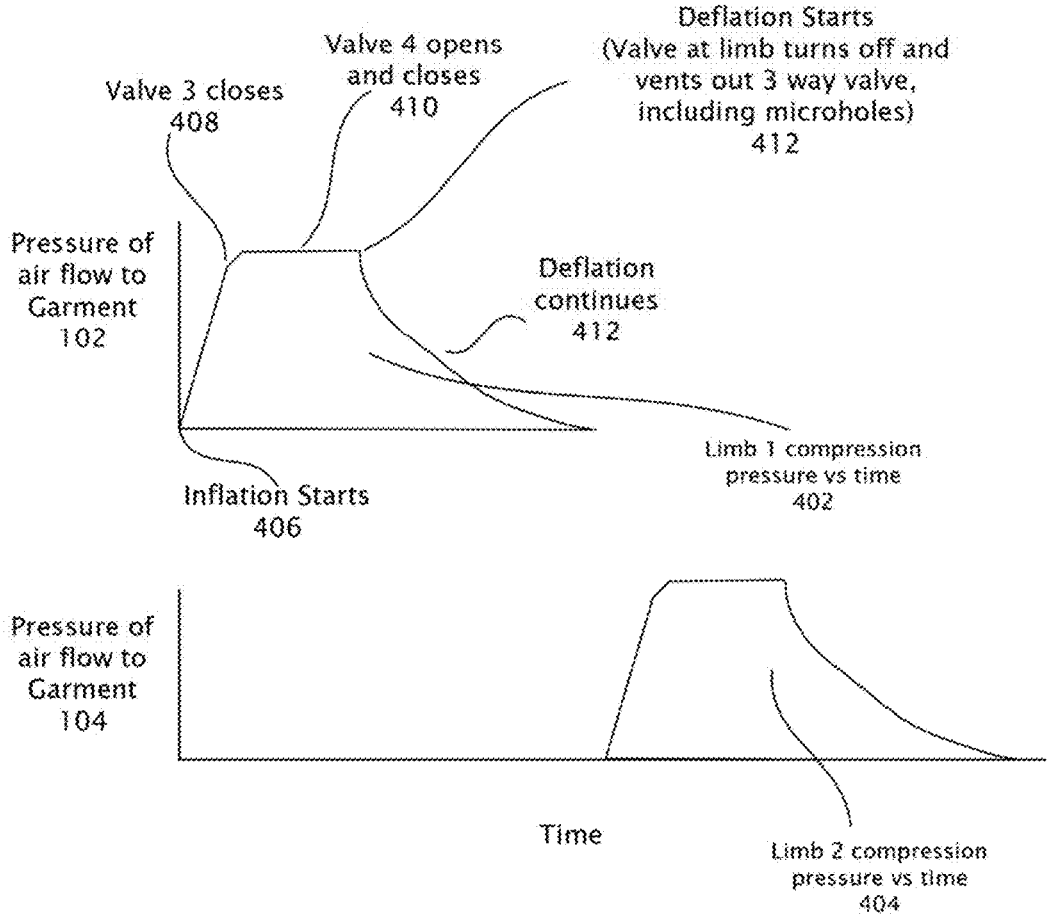
FIG. 4 is a graph showing the pressure generated in each of the garments as a function of time, as caused by the operation of the 4 valve manifold.

FIG. 4 is a graph showing the pressure of the air flow fed into each of the garments as a function of time, as caused by the operation of the 4 valve manifold. The graphs of the pressure of the air flow fed into the garments on limb 1 402 and limb 2 404 are shown offset for clarity. At point 406, inflation in the garment on limb 1 begins. At this point, valves 3 and 4 are open and the garment is rapidly filling, primarily through valve 3. At point 408, the pressure of the air flow fed into the garment is approaching the first predetermined pressure, valve 3 closes and air continues to flow to the garment from valve 4 through the orifice. At the plateau on the graph 410, valve 4 opens and closes to maintain the therapeutic pressure between the upper set-point and lower set-point. At point 412, all valves are closed and air leaks from the garment through the micro holes. As the pressure in the garment on limb 1 decays to zero, the timer begins the pressurization of the garment on limb 2, which follows the same process as described above for limb 1.

Figure 5:
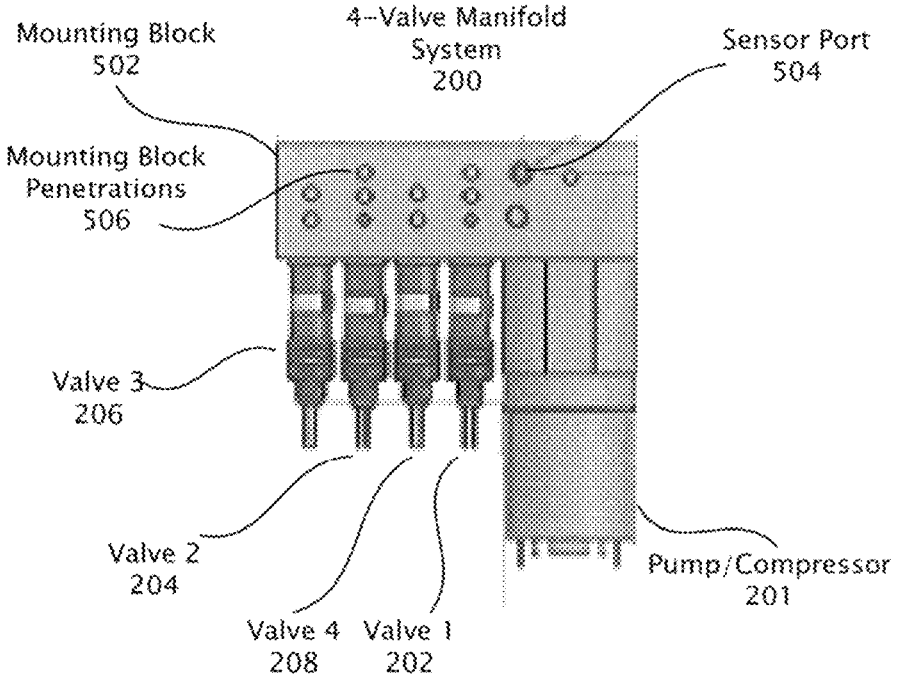
FIG. 5 shows a plan view of an exemplary 4-valve manifold system of the pressure supply and control unit.

FIG. 5 shows a plan view of an exemplary 4-valve manifold system 200. The 4-valve manifold system comprises a mounting block 502 to which the 4 valves (202, 204, 206, 208) are mounted. The pump 201 is mounted to the mounting block 502 adjacent to the valves. In equivalent examples the valve arrangement shown may be maintained on a smaller mounting block having the compressor 201 mounted elsewhere. The mounting block 502 has multiple penetrations 506 for mounting, as well as a sensor port 504 for placing the pressure sensor 212.

The valves 202, 204, 206, 208 are of typical construction and operate as previously described, and are electromechanical devices having control signals supplied via external wiring (not shown). The pump 201 is also of conventional construction to provide a desired air flow and is controlled by external wiring (not shown). The mounting block 502 is mad of any suitable rigid material such as metal, molded plastic or the like. The mounting block includes passageways for air flow between the valves as previously described, and outlets to couple air flow to the pressure garments.

Figure 6:
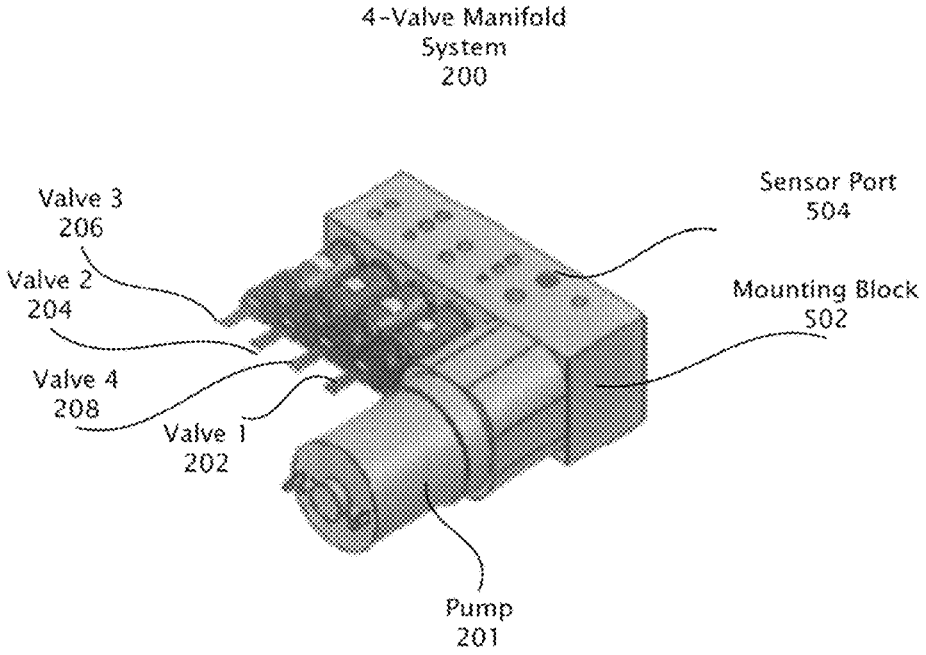
FIG. 6 shows an isometric view of the exemplary 4-valve manifold system.

FIG. 6 shows an isometric view of an exemplary 4-valve manifold system, also showing the 4-valve manifold system with a mounting block 502, the 4 valves (202, 204, 206, 208), and the pump 201.

Figure 7:
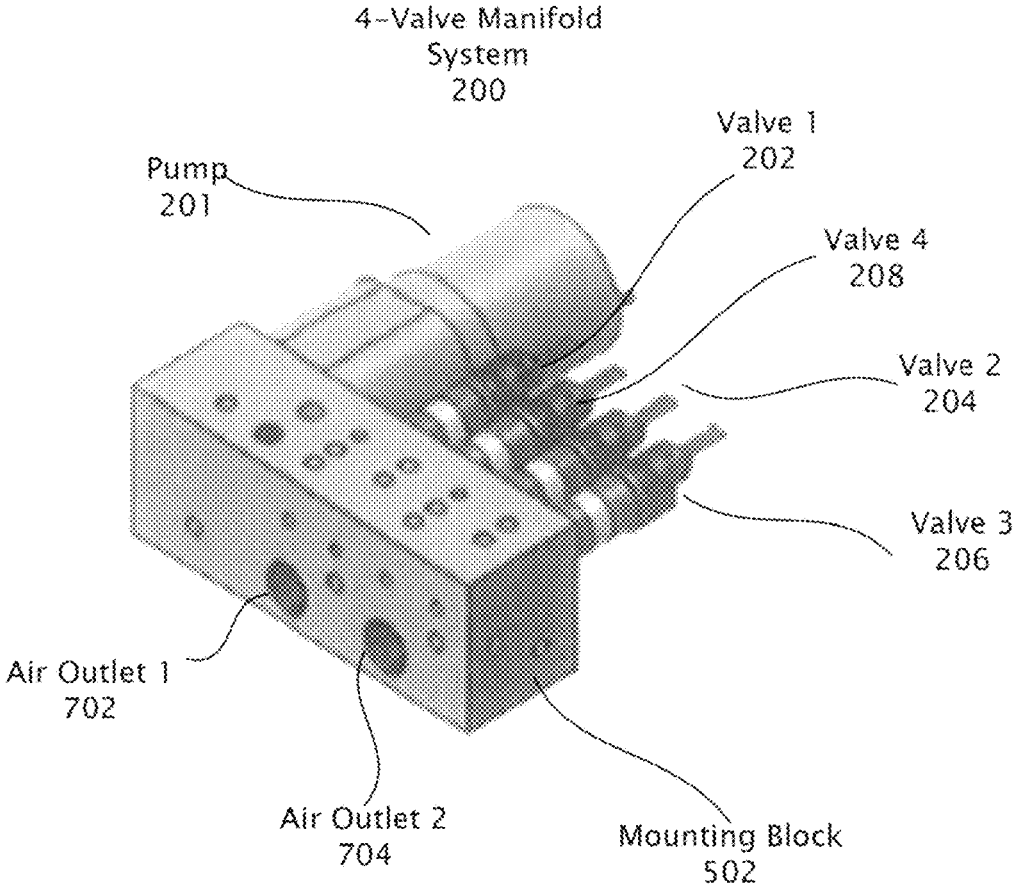
FIG. 7 is the opposite isometric view of the exemplary 4-valve manifold system.

FIG. 7 is the opposite isometric view of the exemplary 4-valve manifold system. In addition to providing a mounting structure for the pump 201 and valves 202, 204, 206, 208, two air outlet ports 702 and 703 are present in the bottom of the mounting block 502. These air outlet ports are the site where the pneumatic connector tubing 106 may be coupled for air delivery to inflate the garments (102 and 104 of FIG. 2).

Since a variety of garments may be coupled to the pressure supply and control unit (108 of FIG. 2), it may be desirable to provide circuitry or another method that allows for identification of the garment attached, so that proper pressures appropriate to the garment may be applied.

Figure 8:
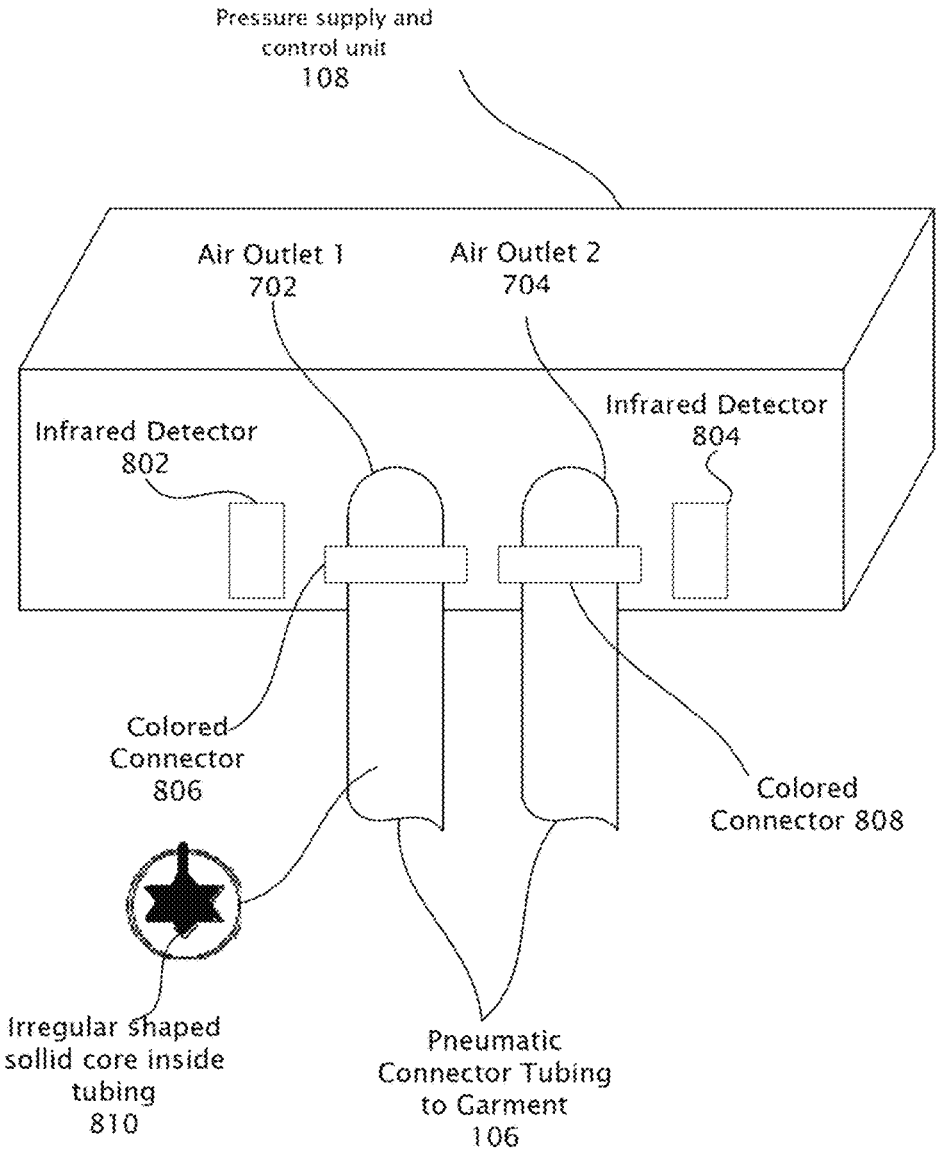
FIG. 8 shows infrared detectors and colored connectors on the pneumatic connector tubing for coupling the pneumatic compression device to the garment.

FIG. 8 shows the infrared detectors and colored connectors on the pneumatic connector tubing. The infrared (IR) detection system utilizes optical sensing to determine the particular type garment, such as a foot garment, that is coupled to it so the differing air pressure and/or flow requirements of various garments may be provided automatically. Some other available systems employ a magnetic switch, or use radio frequency or microprocessors that attempt to detect which garment is attached by its fill. These may be inaccurate due to the variability of the patient flesh density and the tightness of the wrapping on the limb.

This detection system uses an IR optical sensor 802 and 804 attached to the case of the pressure supply and control unit 108 adjacent to where the pneumatic connector tubing 106 connector couples to the air outlets 702 and 704. The IR sensor detects the color of the connector 806 and connector 808 attached to the tubing 106 and then signals the controlling circuitry to choose corresponding operating pressure parameters accordingly. In one example, an irregular shaped core 810 may be disposed at the center of the pneumatic tubing 106. Such a structure tends to allow air flow if the tubing 106 is crushed, pinched or kinked.

The use of colored connectors and IR detection improves upon the currently used microprocessors that evaluate the time to fill a garment as the trigger to turn on a higher pressure to the garment, over that of RF with a typically a hidden toroidal inductor or equivalent in the connector. The use of colored connectors with IR detection tends to eliminate side effects such as electromagnetic interference from a microprocessor or the generation of a radio frequency bubble (generally a volume of space in which radio frequency interference may be present) that might adversely affect other equipment in a hospital setting.

Figure 9:
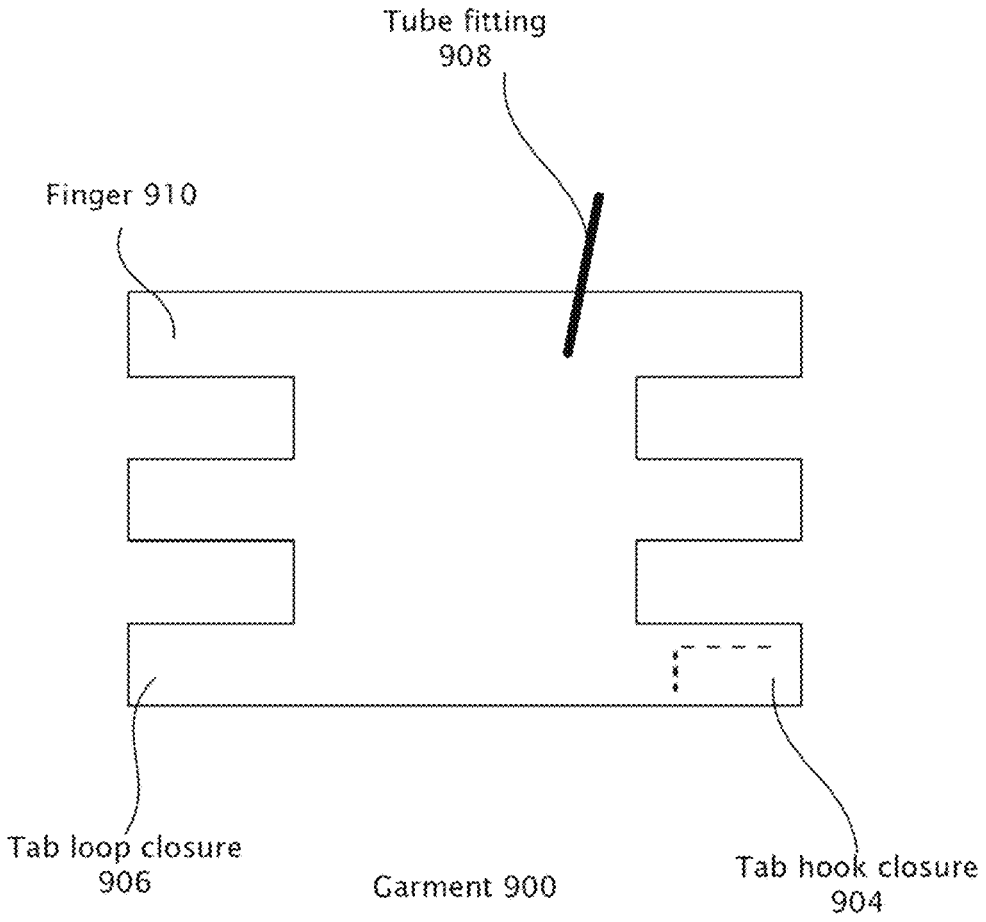
FIG. 9 shows an exemplary garment for use with the pneumatic compression device.

FIG. 9 is a representation of an exemplary garment for use with the present invention. The garment 900 has a symmetrical shape that that allows the nesting of garments together when they are cut out so there is no linear waste in their manufacturing, effectively eliminating all waste that is associated with cutting a conventional asymmetrical garment.

A unique feature of the design is that the tab hook closure 904 may be placed on one side as drawn but the tab loop closure area 906 can be made anywhere on the surface of the garment since the entire exterior (or portions thereof) may be made from loop material, thereby accommodating every possible limb circumference variation as long as it connects to the garment shape, also allowing the garment to fit variable sized calves that have variable circumferences at the different tab attachment points.

For example uniform spacing of the fingers (exemplary singer shown at 910), and equal sized fingers 910 allow a high yield of usable material with a minimum of waste. This garment is suitable for both right and left limbs, eliminating the need for different garments for the opposite limb. The garment may be made of any suitable material such as cloth or the like. The product may be die cut, thereby having essentially a no manufacturing waste.

The garment may include individually applied tabs 904 of hook and loop tape to match with the matching tabs of hook 906 and loop tape (individual tab not shown) for attachment when in use. However in the preferred example and as previously described the entire outside surface of the garment may be loop material that allows increased flexibility in fitting the garment. Alternatively other types of equivalent fasteners may be used.

The garment typically includes an internal bladder (not shown) that inflates and deflates through action of the pressure supply and control unit (108 of FIG. 1). The garment may include a single chamber. Or in alternative examples meandered chambers or multiple chambers may be utilized. The bladder may be mad of any suitable material that may hold air, such as plastic, vinyl, rubber, or the like. The bladder may be bonded to the fabric, sewn between fabric layers or otherwise secured so that it will not shift while in use.

Garments may typically be produced for the foot, thigh, calf, and the like. In one example, the garment is an inflatable garment with an internal bladder or chamber enclosed by material or has a connector with micro holes (not shown) such that pressurized air within the chamber may be leaked with desired leakage rate.

The garment includes a tube fitting 908 coupled to the chamber for receiving air flow via the pneumatic connector tubing 106. Inflatable garment is well known to one of ordinary skill in the art. Alternatively the tubing may be integral to the garment, instead of being removable so that there is a single connection to the pump unit.

Figure 10:
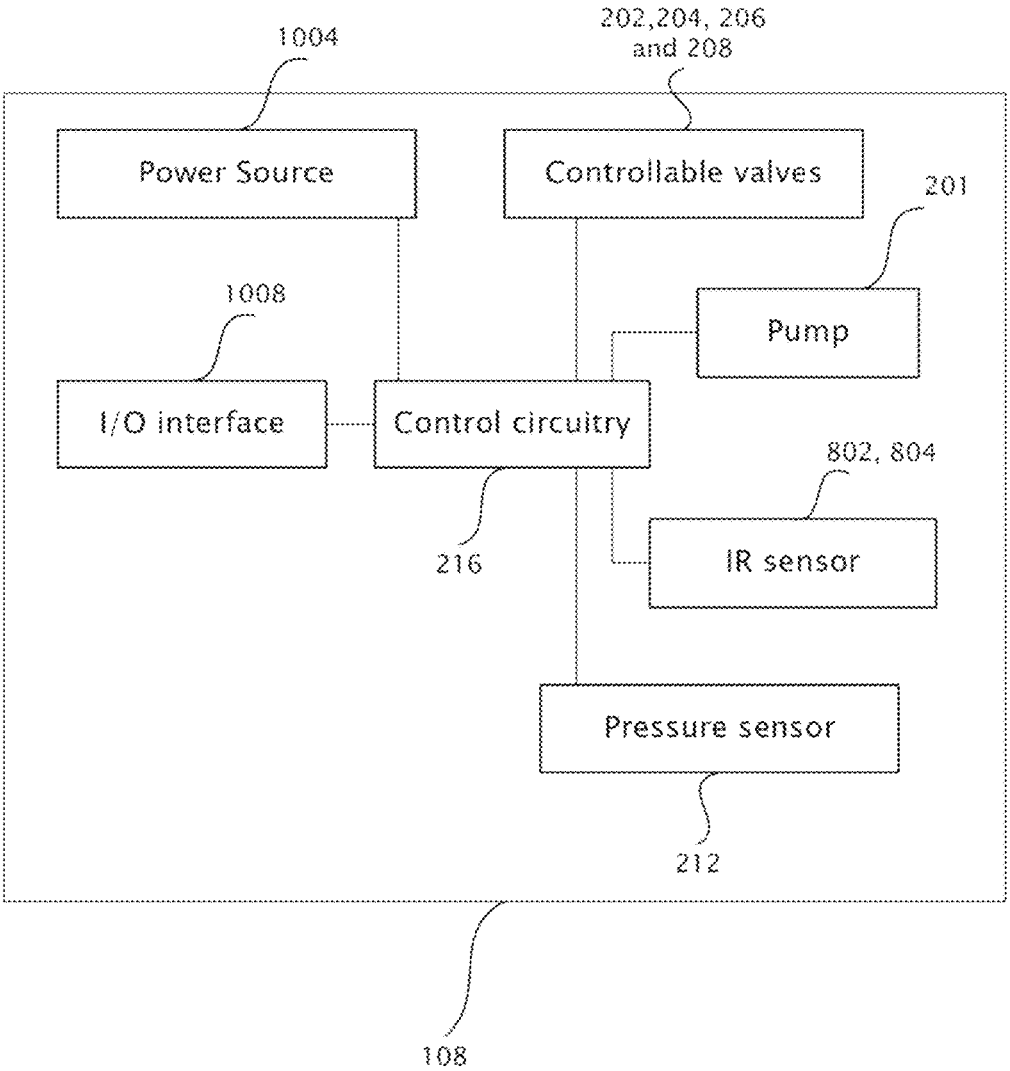
FIG. 10 is a block diagram of the pressure supply and control unit.

FIG. 10 is a block diagram of the pressure supply and control unit according to various examples of the invention showing further details of the controller circuitry. The pressure supply and control unit 108 comprises the air pump 201, the valves 202, 204, 206 and 208, the pressure sensor 212, the IR sensors 802 and 804, the controlling circuitry 216, a power source 1004. The controlling circuitry 216 receives input from the pressure sensor 108, the IR sensors 802 and 804, and generates output to switch ON/OFF one or more of the plurality of the valves 202, 204, 206 and 208. The power source 1004 may be a battery or a power input from a wall plug. In alternative examples, the pressure supply and control unit 10 may include a memory (not shown) loaded with non-volatile controlling logic accessible and executable by the controlling circuitry 216 for implementation of desired operation procedures for generating air flow and control air pressure. The optional memory (not shown) may be an external memory module or integrated within the controlling circuitry 216 as an on-chip memory. The controlling circuitry 216 may be a microprocessor, a microcontroller, a programmable logic controller, or the like.

In some examples, the pressure supply and control unit 108 includes at least one I/O interface, such as a touch screen, a keyboard, a PIN pad, coupled to the controlling circuitry 216. A patient or user may manually edit the operation parameters, such as the upper pressure set-point and lower pressure set-point, via the I/O interface.

Those skilled in the art will realize that various configurations may be used for air movement control and pressure regulation. The foregoing description of the invention has been described for purposes of clarity and understanding. It is not intended to limit the invention to the precise form disclosed. Various modifications may be possible within the scope and equivalence of the appended claims.

The invention claimed is:

1. A pneumatic compression device comprising:

a pump generating a compressed air flow;

a plurality of controllable valves regulating the compressed air flow to a compression garment, wherein the compression garment or a pressurized pathway allows air leakage;

a pressure sensor monitoring the pressure of the regulated compressed air flow; and a controlling circuitry coupled to the plurality of controllable valves and the pressure sensor, the controlling circuitry receiving input from the pressure sensor to switch on or off one or more of the plurality of the controllable valves based at least on the pressure sensor input;

wherein the pressure of the regulated compressed air flow is dynamically controlled, and wherein the plurality of controllable valves comprises two parallel upstream valves each receiving air from the pump, and two downstream distribution valves each configured to receive air from the two parallel upstream valves, and to route the compressed air flow to the compression garment via one of the downstream distribution valves, and wherein the device further comprises an orifice placed after only one of the two parallel upstream valves, such that the compressed air flow from the one of the two parallel upstream valves is throttled by the orifice, and wherein when the pressure of the regulated compressed air flow reaches a first predetermined pressure, the controlling circuitry switches on the upstream valve with the orifice throttling and switches off the other upstream valve, such that the regulated air flow to the garment is solely through the orifice.

2. The pneumatic compression device of claim 1 wherein after the regulated compressed air flow reaches the first predetermined pressure, the controlling circuitry dynamically maintains the regulated compressed air flow pressure between an upper pressure set-point and a lower pressure set-point.

3. The pneumatic compression device of claim 2 wherein when the regulated compressed air flow reaches the upper pressure set-point, the controlling circuitry closes the upstream valve with the orifice throttling; wherein when the regulated compressed air flow reaches the lower pressure set-point, the controlling circuitry opens the upstream valve with the orifice throttling.

4. The pneumatic compression device of claim 2, wherein the regulated compressed air flow pressure has been dynamically maintained for a predetermined amount of time, the controlling circuitry closes the downstream distribution valve used for routing the regulated compressed air flow.

5. The pneumatic compression device of claim 1 wherein the device further comprises a colored tubing connector coupling to air outlets of the pneumatic compression device, wherein the color of the color tubing connector represents the type of the compression garment.

6. The pneumatic compression device of claim 5, wherein the device further comprises an optical sensor coupled to the controlling circuitry, wherein the optical sensor detects the color of the color tubing connector and signals the controlling circuitry to choose corresponding operation parameters related to the type of the compression garment that the color tubing connector represents.

7. A method of applying regulated compressed air flow to a compression garment for circulation improvement, the method comprising:

generating a compressed air flow from a pump;

regulating the compressed air flow to the compression garment via a plurality of controllable valves, wherein the compression garment allows air leakage;

monitoring the pressure of the regulated compressed air flow via a pressure sensor; and dynamically controlling the pressure of the regulated compressed air flow with a controlling circuitry coupled to the plurality of controllable valves and the pressure sensor;

wherein the controlling circuitry receives input from the pressure sensor to switch on or off one or more of the plurality of the controllable valves based at least on the pressure sensor input, wherein the plurality of controllable valves comprises two parallel upstream valves each receiving air from the pump and two downstream distribution valves each configured to receive air from the two parallel upstream valves, and to route the compressed air flow to the compression garment via one of the downstream distribution valves, wherein an orifice is placed after only one of the two parallel upstream valves such that the compressed air flow from the one of the two parallel upstream valves is throttled by the orifice, wherein when the pressure of the regulated compressed air flow reaches a first predetermined pressure, the controlling circuitry switches on the upstream valve with the orifice throttling and switches off the other upstream valve, such that the regulated air flow to the garment is solely through the orifice.

8. The method of claim 7 wherein after the regulated compressed air flow reaches the first predetermined pressure, the controlling circuitry dynamically maintains the regulated compressed air flow pressure between an upper pressure set-point and a lower pressure set-point.

9. The method of claim 8 wherein when the regulated compressed air flow reaches the upper pressure set-point, the controlling circuitry closes the upstream valve with the orifice throttling; wherein when the regulated compressed air flow reaches the lower pressure set-point, the controlling circuitry opens the upstream valve with the orifice throttling.

10. The method of claim 8 wherein when the regulated compressed air flow pressure has been dynamically maintained for a predetermined amount of time, the controlling circuitry closes the downstream distribution valve used for routing the regulated compressed air flow.

11. A pneumatic compression device comprising:

a pump generating a compressed air flow;

two parallel upstream valves each receiving air from the pump and two downstream distribution valves each configured to receive air from the two parallel upstream valves, and to regulate and route the compressed air flow, wherein one downstream distribution valve is coupled to a first breathable garment and the other downstream distribution valve is coupled to a second breathable garment;

a pressure sensor monitoring the pressure of the regulated compressed air flow; and a controlling circuitry coupled to the two parallel upstream valves, the two downstream distribution valves and the pressure sensor, the controlling circuitry receiving input from the pressure sensor to switch on or off one or more of the upstream and downstream valves based at least on the pressure sensor input;

wherein the pressure of the regulated compressed air flow is dynamically controlled, wherein the two downstream distribution valves are alternatively switched on such that the first breathable garment and the second first breathable garment are alternatively applied with the regulated compressed air flow, and wherein when the pressure of the regulated compressed air flow reaches a first predetermined pressure, the controlling circuitry switches on the upstream valve with an orifice throttling and switching off the other upstream valve, such that the regulated air flow to the garment is solely through the orifice.

* * * * *